US006282823B1

(12) United States Patent
Brown

(10) Patent No.: US 6,282,823 B1
(45) Date of Patent: Sep. 4, 2001

(54) DRIVER COURTESY DEVICE

(76) Inventor: Leo Brown, 17393 Loch Lomond Way, Boca Raton, FL (US) 33434

( * ) Notice: Subject to any disclaimer, the term of this patent is extended or adjusted under 35 U.S.C. 154(b) by 0 days.

(21) Appl. No.: 09/728,521

(22) Filed: Dec. 1, 2000

Related U.S. Application Data

(60) Provisional application No. 60/169,047, filed on Dec. 3, 1999.

(51) Int. Cl.[7] ..... G09F 21/04

(52) U.S. Cl. ..... 40/593; 74/47; 40/218

(58) Field of Search ..... 40/593, 591, 218, 40/423, 492; 74/47

(56) References Cited

U.S. PATENT DOCUMENTS 288,778 * 11/1883 Davis ..... 74/47
851,731 * 4/1907 Daley ..... 74/47
2,147,010 * 2/1939 Cranford .
2,714,266 * 8/1955 Jauquet ..... 40/423 X
2,817,916 * 12/1957 Yarrow ..... 40/423 X
3,678,457 * 7/1972 Lev .
4,176,483 * 12/1979 Bailey ..... 40/591 X
5,450,811 * 9/1995 Heiland ..... 40/218 X
5,628,133 * 5/1997 Cooper ..... 40/591

* cited by examiner

*Primary Examiner*—Joanne Silbermann
(74) *Attorney, Agent, or Firm*—Robert M. Downey, P.A.

(57) ABSTRACT

A driver courtesy device includes a first unit attachable to the dashboard or steering console of an automobile, within reach of the driver of the automobile, and a display unit mounted adjacent the rear window or one of the side windows of the automobile. The first unit includes a signal transmitter actuated by the driver. The display unit includes an upstanding member resembling an arm and hand, a signal receiver, and a motor actuated for a predetermined operational period upon receipt of the signal transmitted by the first unit. An interposer converts rotary motion of the actuated motor to linear motion to thereby move the arm and hand in a reciprocating, waving motion to convey a courteous gesture.

7 Claims, 3 Drawing Sheets

TRANSMITTER

RECEIVER

DRIVER COURTESY DEVICE

This application claims benefit to Provisional Application 60/169,047 filed Dec. 3, 1999.

BACKGROUND OF THE INVENTION

1. Field of the Invention

The present invention is directed to a courtesy device for installation in automobiles and, more particularly, to a device for waving a hand which is visible to other drivers to thereby send a courteous gesture to other drivers within the vicinity of the automobile.

2. Description of the Related Art

Increasing traffic congestion on the world's roads and highways, coupled with the ever increasing stress in the average person's daily routine, has lead to an epidemic of aggressive and sometimes violent actions by drivers, a situation which has come to be known as "road rage." Incidents of road rage commonly involve aggressive, and often dangerous, maneuvering of one or more vehicles involved in a confrontation. More violent incidents of road rage may involve physical fights and, in the most serious cases, the use of weapons including firearms. In recent years, many accidents and deaths on America's highways have been attributed to incidents of road rage.

An act of road rage may be triggered any one of numerous causes including impolite drivers, incompetent drivers, aggressive drivers, and egotistical drivers. In some instances, a driver suffering from personal problems may release their personal anger on other drivers who may simply be in that person's way. Other times, aggressive maneuvers, such as switching lanes and cutting off a driver, may spark an incident of road rage. Regardless of the particular circumstances which may trigger an act of road rage, the underlying cause of road rage is a general lack of courtesy and politeness in today's hectic society.

The present invention proposes to create a renewal of courtesy and politeness among drivers, thereby helping to eliminate road rage on roads and highways of the United States and abroad.

SUMMARY OF THE INVENTION

The present invention is directed to a driver courtesy device and includes a transmitter component attachable to the dashboard or steering console of an automobile, within reach of the driver of the automobile, and display unit mounted adjacent the rear window or one of the side windows of the automobile. The display unit includes an upstanding member resembling an arm and hand, and a motor and interposer means structured for moving the arm and hand in a reciprocating, generally linear motion to simulate a waving hand in conveying a courteous gesture. Upon actuating the transmitter component, via a switch mechanism, a signal is transmitted via invisible light waves to a receiver in the display unit. The hand continues movement through the reciprocating waving action until the timer times out and deactivates the motor.

BRIEF DESCRIPTION OF THE DRAWINGS

For a fuller understanding of the nature of the present invention, reference should be made to the following detailed description taken in conjunction with the accompanying drawings in which.

Like reference numerals refer to like parts throughout the several views of the drawings.

DETAILED DESCRIPTION OF THE PREFERRED EMBODIMENT

Referring to the several views of the drawings, the driver courtesy device of the present invention is shown and generally indicated as 10. The driver courtesy device is specifically intended to help diffuse incidents of road rage by exhibiting a waving hand as a sign of peace and, thereby, sending a peaceful social gesture to other drivers within the vicinity of the automobile and particularly other drivers who might be exhibiting anger, hostility, aggressiveness, etc. It is hopeful that the hostile driver will recognize the sign of the waving hand as an apology or simply a sign of politeness to thereby diffuse a potential incident of road rage. In other instances, the device may be used as a courteous gesture to fellow drivers who have demonstrated politeness or have extended a courtesy, such as allowing the other driver to have the right of way. In this instance, the signal of the waving hand is taken as a "thank you" to the fellow driver.

Figure 1:
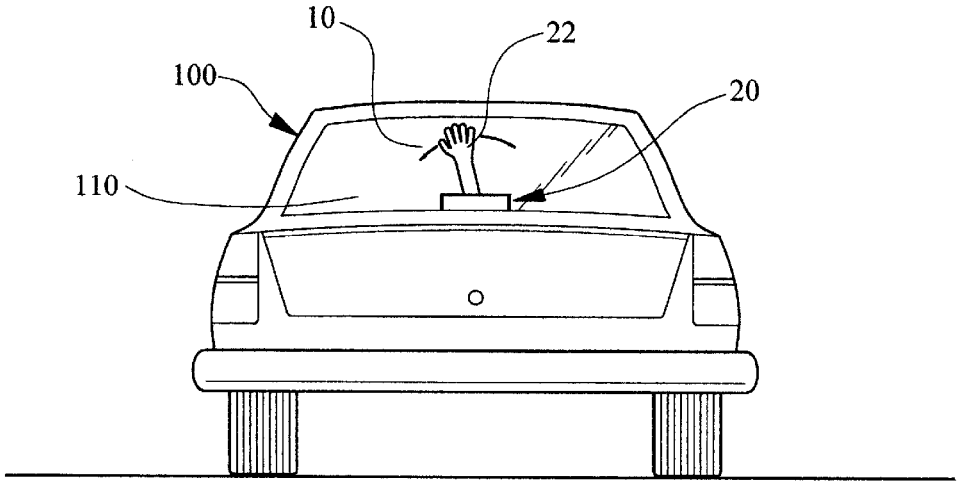
FIG. 1 is a rear elevational view of an automobile, showing the driver courtesy device of the present invention installed therein and visible through the rear window of the automobile.

Referring to FIG. 1, the device 10 of the present invention includes a display unit 20 which mounts on the rear dash of an automobile 100, adjacent the rear window 110, so that an upstanding member 22 resembling an arm and hand is clearly visible to other drivers and occupants of vehicles behind the automobile 100. Alternatively, the display unit, with the waving arm and hand, may be mounted to the one of the side windows of the vehicle.

Figure 2:
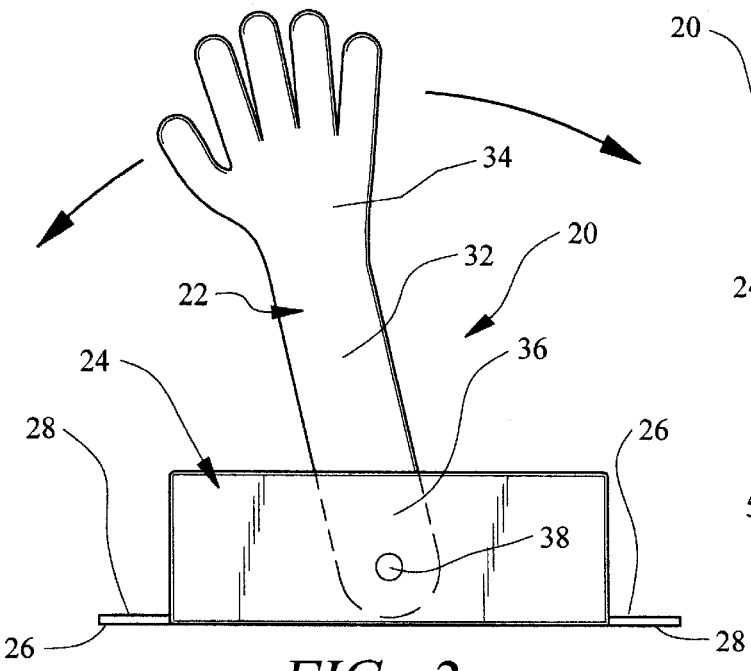
FIG. 2 is a front elevational view of an electromechanical component of the driver courtesy device of the present invention in accordance with one embodiment thereof.
Figure 3:
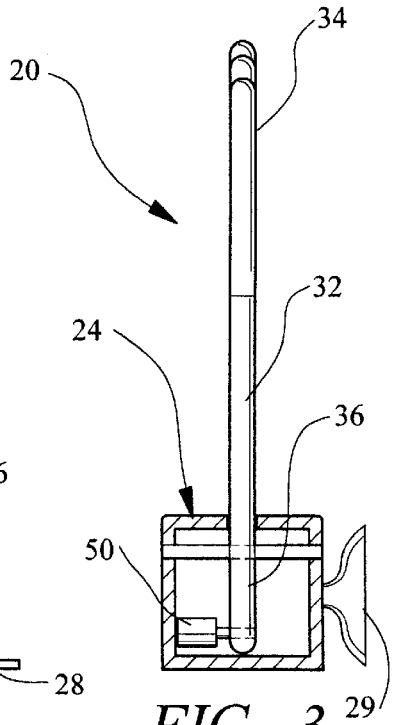
FIG. 3 is a side elevational view of an electromechanical component of the driver courtesy device showing alternative means for mounting the device to a window.
Figure 4:
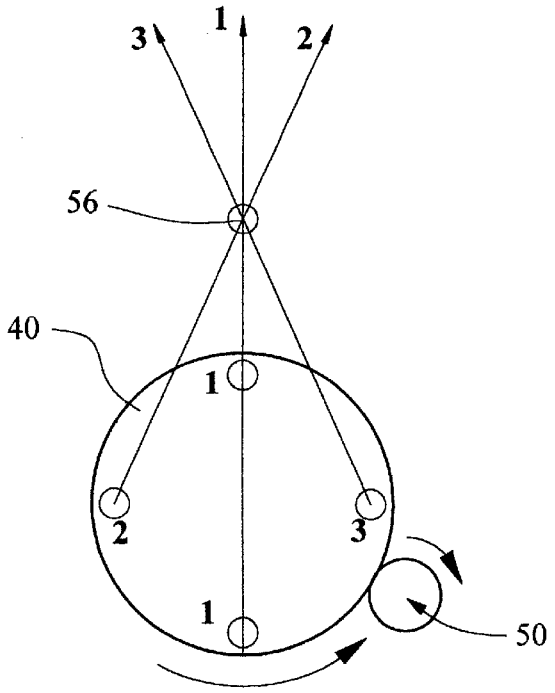
FIG. 4 is a general diagram showing a rotor and motor arrangement illustrating a sequence of arm positions about a full rotation of the rotor.

Referring to FIGS. 2 and 3, the display unit 20 is shown in accordance with a preferred embodiment thereof. Specifically, the display unit 20 shown in FIG. 2 includes a housing 24 which may include means 26 for mounting the housing 24 to the rear dash of the automobile 100. The mounting means may include extending leg members 28 with apertures formed therethrough to receive a mounting screw or other fastening element in order to secure the housing 24 to the rear dash of the automobile. Alternatively, the leg members 28 and rear dash may be provided with cooperatively positioned magnet means for removably attaching the housing 24 on the rear dash. Other means such as clips, hook and loop fasteners, brackets and the like may be used to mount the display unit 20 in the automobile. In other embodiment, the housing 24 may be provided with one or more suction cups 29 for removably attaching the display unit 20 to the inside surface of the rear window or one of the side windows of the automobile 100. The upstanding member 22 of the display unit 20 includes an arm portion 32 and an integral hand-shaped portion 34. A lower proximal end 36 of the arm portion 32 includes a pin 38 for attaching the arm portion 32 to a rotor disk 40, as seen in FIG. 5.

In a preferred embodiment, the display unit 20 is provided with a small direct current DC motor 50 for drivingly rotating the circular rotor disk 40. The output shaft of the motor 50 includes a gear 52 which engages an outer circumferential edge 42 of the rotor disk 40. The gear 52 is of a substantial smaller diameter than the rotor disk, thereby reducing the number of revolutions per minute of the rotor disk in relation to the output shaft of the motor. Accordingly, the larger diameter rotor disk 40 rotates at a fraction of the motor speed. As mentioned above, the rotor disk 40 supports the arm portion 32, which rides on a floating pivot point 56. As depicted in FIG. 1, the various positions of the arm portion 32 are shown as the rotor disk 40 rotates through a complete revolution. The rotor disk supports the moving arm portion 32 and acts as a cam surface with the arm portion. The arm portion 32 is slotted at 39 about the pivot point 56 to minimize the complexity of the interposer means. Movement of the arm portion 32 and hand-shaped portion 34 is in a generally linear back and forth motion, to simulate the waving of a hand in a manner which conveys a courteous gesture.

Figure 5:
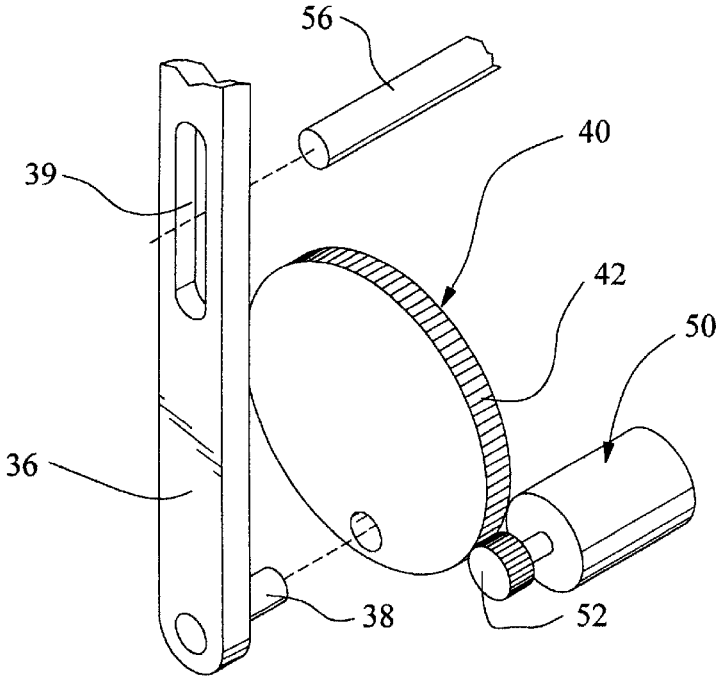
FIG. 5 is an isolated perspective view showing the components of an interposer structure, including the rotor, motor and arm generally depicted in the diagram of FIG. 4, for converting rotary motion to linear motion.

Referring to FIG. 5, the DC motor 50 is shown with the gear 52 in driven engagement with the outer circumferential gear face 42 of the rotor disk 40. The size relationship between the two allows a small low torque motor to take advantage of the torque multiplication gained via the gear ratio.

Figure 6:
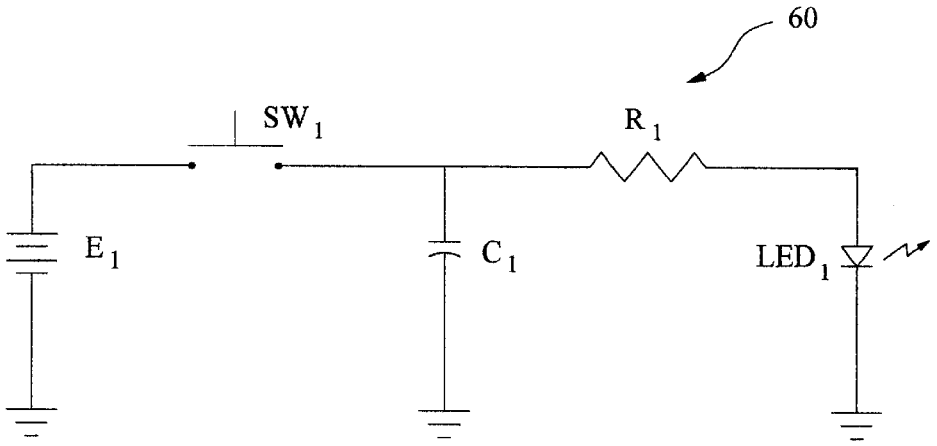
FIG. 6 is a schematic diagram of a transmitting component, in accordance with a preferred embodiment of the invention.

Referring to FIG. 6, a transmitter component 60 of the invention is shown in a schematic diagram, The transmitter component 60 uses properties of a light emitting diode operating in the visible spectrum. The schematic diagram El indicates the power source which can be internal batteries or, alternatively, the vehicle power source wherein the transmitter component 60 is plugged into the vehicle cigarette lighter. SW1 is a momentary push switch that allows the vehicle operator to activate the transmitter component 60. With the switch depressed, capacitor C1 is charged and current flows through LED1 and is limited by resistor R1. When the switch is released, the stored charge in the capacitor C1 allows the diode LED1 to conduct for a slightly extended period of time and provides a smooth, noise-free turn off.

While the transmitter component 60 is addressed as a single unit, it can be made into two independent units which will allow the switch to be placed in close proximity to the driver with the light emitting diode being placed in area of the rear view mirror to allow a more direct path between the light emitting diode LED1 and the receiver in the display unit. The values of the components depicted in FIG. 6 must be calculated based on the type of light emitting diode selected for LED1 and the voltage selected for the power source E1.

Figure 7:
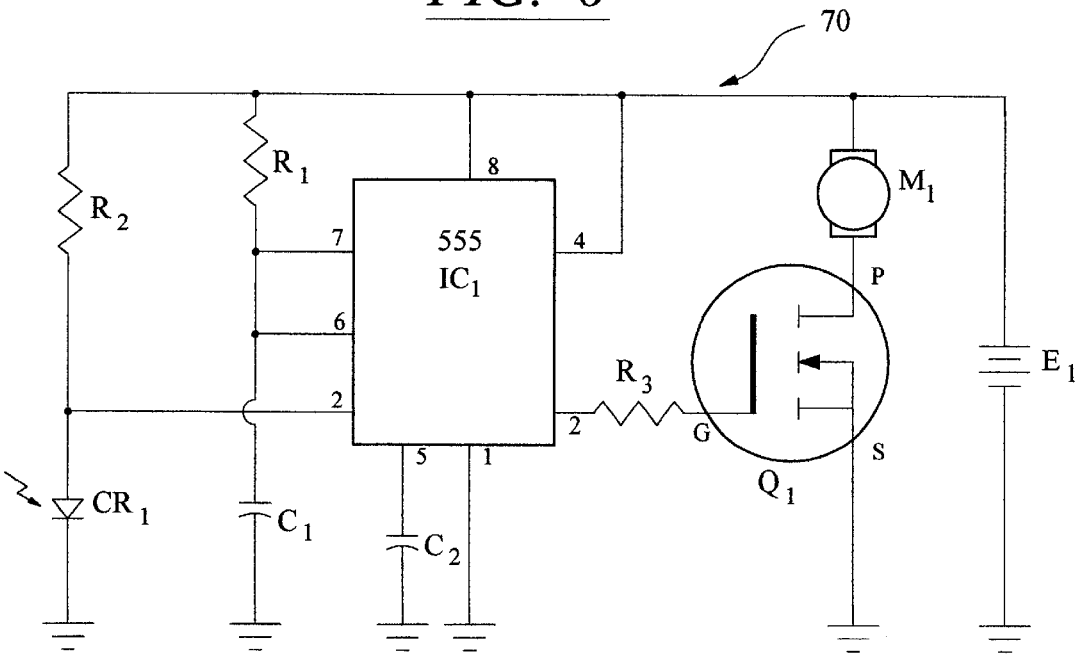
FIG. 7 is a schematic diagram of a receiver circuit on the display unit, in accordance with a preferred embodiment of the invention.

The display unit 20 is provided with a receiver 70 which is shown schematically in FIG. 7. Specifically, the circuit of the receiver 70 in the display unit 20 incorporates the use of a 555 IC timer which is activated via the IR diode CR1. When CR1 detects a signal from the transmitter unit in the vehicle, the monostable multi-vibrator IC1 is activated. The period of activation is determined by the values of resistor R1 and capacitor C1.

While activated, IC1 causes the power FET transistor Q1 to conduct via resistor R3. The motor, M1, is connected between the power source E1 and the drain of Q1, which allows the motor to run for the duration of the multi-vibrator timeout period. When the multi-vibrator has timed out, its output circuit at pin 3 will go to a logical low, Q1 will cease to conduct, and M1, the motor, will stop. Activation of the transmitter will start the cycle again by causing CR1 to conduct, which in turn will force the input pin 2 of the multi-vibrator, IC1 to go to a logic low. This starts the charging cycle of R1 and C1 and the multi-vibrator will start another cycle.

Power for the receiver and associated motor is provided by internal batteries or, alternatively, via a connection to the vehicle's power distribution system. As in the case of the transmitter component, all values of the components of the receiver will need to be calculated based on the motor requirements and the diode utilized for CD1.

While the instant invention has been shown and described in accordance with what is considered to be a preferred and practical embodiment thereof, it is recognized that departures from the instant disclosure may be made within the spirit and scope of the present invention.

What is claimed is:

1. A device to be installed within a motor vehicle to allow a driver of the motor vehicle to exhibit a sign of courtesy to others outside of the vehicle, said device comprising:

a first unit positionable within reach of the driver of the motor vehicle and including a signal transmitter structured and disposed for transmitting signals and an actuator control operable by the driver for actuating said signal transmitter;

a second unit comprising:

a base including an electric motor;

means for removably mounting said base within the vehicle;

a display member including a first portion formed and configured in the shape of a hand and a second elongate portion extending from said first portion and formed and configured in the shape of an arm, said second portion including a lower proximal end opposite to said first portion;

means for connecting said lower proximal end of said second portion to said base in driven engagement with said electric motor and including a plurality of gears, said plurality of gears including a drive gear and a rotor gear, said rotor gear including means for pivotal mounting of said lower proximal end of said second portion of said display member thereto;

receiver means communicating with said signal transmitter and being structured and disposed for receiving said transmitted signals, and said receiver means communicating with said electric motor to actuate said motor for a predetermined period of time upon receipt of said transmitted signals from said signal transmitter; and means for causing reciprocating motion of said display member upon actuation of said motor so that said first portion of said display member moves through an arc of 180° or less in a manner resembling a waving hand which is visible to others outside of the motor vehicle, and said means for causing reciprocating motion including a floating pivot defined by a slotted opening formed in said proximal end of said second portion and a fixed pivot pin received through said slotted opening and said proximal end and said slotted opening being movable relative to said fixed pivot pin upon driven movement of said proximal end by said rotor gear.

2. The device as recited in claim 1 wherein said means for removably mounting said base within the vehicle includes bracket members extending from said base, said bracket members being structured and disposed for mounting to the interior of the vehicle using conventional fasteners.

3. The device as recited in claim 1 wherein said means for removably mounting said base within the vehicle includes one or more suction cups for removably mounting said base to an inner window surface of the vehicle.

4. A device adapted to be installed within a motor vehicle to allow a driver of the motor vehicle to exhibit a sign of courtesy to others outside of the vehicle, said device comprising:

a base including an electric motor;

means for removably mounting said base within the vehicle;

a display member including a first portion and a second portion extending from said first portion, said portion including a lower proximal end opposite to said first portion;

means for connecting said lower proximal end of said second portion to said base in driven engagement with said electric motor and including a plurality of gears, said plurality of gears including a drive gear driven by said motor and a rotor gear driven by said drive gear, said rotor gear including means for pivotal mounting of said lower proximal end of said second portion of said display member thereto;

means operable by the driver of the motor vehicle for actuating said electric motor for a predetermined period of time; and means for causing reciprocating motion of said display member upon actuation of said motor so that said portion of said display member moves through an arc of 180° or less in a manner resembling a waving hand, and said means for causing reciprocating motion including a floating pivot defined by a slotted opening formed in said proximal end of said second portion and a fixed pivot pin received through said slotted opening and said proximal end and said slotted opening being movable relative to said fixed pivot pin upon driven movement of said proximal end by said rotor gear.

5. The device as recited in claim 4 wherein said first portion of said display member is formed and configured in the shape of a hand and said second portion is formed and configured in the shape of an arm.

6. The device as recited in claim 5 wherein said means for removably mounting said base within the vehicle include bracket members extending from said base, said bracket members being structured and disposed for mounting to the interior of the vehicle using conventional fasterners.

7. The device as recited in claim 5 wherein said means for removably mounting said base within the vehicle includes one or more suction cups for removably mounting said base to an inner window surface of the vehicle.

* * * * *